US005150661A

United States Patent [19]

Rudolf

[11] Patent Number: 5,150,661

[45] Date of Patent: Sep. 29, 1992

[54] RETRACTABLE STEERING DEVICE FOR CARGO BARGES THAT INCREASES MANEUVERABILITY BY PROVIDING A PIVOT POINT OR POINTS WHEN ALTERING COURSE

[76] Inventor: William B. Rudolf, 10001 Point Aux Chenes Rd., Ocean Springs, Miss. 39564

[21] Appl. No.: 530,639

[22] Filed: May 30, 1990

[51] Int. Cl.[5] ..... B63H 25/00

[52] U.S. Cl. ..... 114/26; 114/63; 114/73; 114/128; 114/132; 114/138; 114/246

[58] Field of Search ..... 114/246, 249-252, 114/152, 242, 128, 165, 129, 132, 137, 141, 73, 26, 63, 138

[56] References Cited

U.S. PATENT DOCUMENTS

| | | | |
|---|---|---|---|
| 1,032,965 | 7/1912 | Tilton | 114/162 |
| 1,356,218 | 10/1920 | Nowland | 114/246 |
| 2,021,629 | 11/1935 | Leigh | 114/26 |
| 3,326,168 | 6/1967 | Swiggart et al. | 114/128 |
| 3,804,052 | 4/1974 | Lucht | 114/251 |
| 4,217,844 | 8/1980 | Gruzling | 114/63 |
| 4,506,621 | 3/1985 | Vanlerberghe | 114/165 X |
| 4,928,613 | 5/1990 | Rudolf | 114/132 X |

*Primary Examiner*—Sherman Basinger

*Attorney, Agent, or Firm*—Pravel, Gambrell, Hewitt, Kimball & Krieger

[57] ABSTRACT

A retractable steering device for liquid/bulk cargo carrying barges includes a rectangular barge hull having a generally flat bottom and an upper deck and generally vertical port and starboard sidewalls. A cargo hold is contained at the central portion of and within the barge hull for containing a liquid or bulk cargo. Port and starboard wing tanks are positioned respectively between the port and sidewalls of the hull and the cargo hold. A pair of longitudinally extending slots are positioned adjacent the respective port and starboard wing tanks, each defining an opening that communicates at least with the barge bottom to provide an opening to the sea under the barge bottom. A pair of respective port and/or starboard, bow or stern spaced apart steering members are adapted to move within their respective slots, and each being movable between an extended position wherein the steering member extends downwardly well below the barge bottom to increase maneuverability when the barge is being pushed, and in a retracted position wherein the steering member is protectively contained within the slot. The steering members are rotatable about a vertical axis when extended to aid in turning of the barge.

9 Claims, 6 Drawing Sheets

RETRACTABLE STEERING DEVICE FOR CARGO BARGES THAT INCREASES MANEUVERABILITY BY PROVIDING A PIVOT POINT OR POINTS WHEN ALTERING COURSE

BACKGROUND OF THE INVENTION

1. Field of the Invention

The present invention relates to a retractable steering device for use on barges carrying bulk or liquid cargo. Even more particularly, the present invention relates to an improved bulk/liquid cargo barge having an enlarged laterally extending cargo hold, peripherally positioned wing tanks, improved maneuverability using steering members positioned to retract at the wing tanks (on bulk cargo models) and/or centrally of the cargo hold (on liquid cargo models), for increasing maneuverability, providing a point or points of resistance under water on barge's bottom around which a tow can be turned (pivotal point or points), to make navigating barges safer, particularly when empty, reduce crabbing and to increase fuel efficiency of the vessel propelling the barges.

2. General Background

Barges are used for transporting a number of different types of cargo over long distances via water. Typically, coal, grain, oil, and other types of bulk and liquid cargo can be shipped in large volumes with flat cargo barges. Barges are typically flat rectangular vessels having vertical side walls and vertical end portions with a flat bottom and deck. The barges are rectangular in plan. This shape allows several barges to be lashed together end-to-end and side-to-side to form what is known in the industry as a "tow".

Cargo barges are unpowered vessels and thus when lashed together as part of a tow they are moved using a powered vessel, typically a tug. The tug is usually lashed to the rear portion of a tow which can be very long. For example, the tow itself may be substantially wider than the tug and sometimes five (5) or ten (10) times the length of a tug in length.

To navigate with such a tow is often a problem when cross winds or strong currents are incurred. This problem is aggravated when a combination of cross wind and strong current makes the front end portion of the tow very hard to control for a tug which is located at the very rear portion of the tow. Sometimes the tow is empty having unloaded its cargo, or possibly when the tug is pushing the tow to a location for the purpose of loading. Empty barges are more susceptible to wind and current forces, thus making steering more difficult.

In order to compensate for cross winds and strong cross currents, a "crabbing" type of posture is assumed by the entire tow. The tug boat operator is forced to slant his vessel at an angle with respect to his intended direction in order to overcome the forces of wind and current acting upon the entire tow. This component is basically lost energy. Further, tows which are required to assume a crabbing posture in order to maneuver in narrow channels or rivers during high cross wind conditions create a hazard to navigation, e.g., navigating through bridges with limited horizontal clearance. Tows can be unstable in strong cross winds or in strong current conditions and especially when the barges form an elongated tow of several barges and especially when the barges are empty. Further, tugs can waste substantial amounts of fuel when an inefficient crabbing type of posture is required in order to maintain a course. In addition, the pivotal point or points afforded by this invention would make a radical change in the course of a tow (as when a tow has to change course significantly then pass through a bridge or enter a lock) more efficient and safer.

Several patents have been granted which relate to barges and steering mechanisms therefor. Additionally, center board type arrangements have been used for sailing vessels for purposes of stability and to prevent crabbing when the wind is acting upon the sail of a vessel. Stabilizers have been used on ocean going ships and powered vessels for the purpose of maintaining a course for that vessel. U.S. Pat. No. 6,299 entitled "Centre Board and Keel", issued Apr. 10, 1849 describes a wooden sailboat having a pivoting keel.

U.S. Pat. No. 890,045 entitled "Boat", issued Nov. 11, 1907 shows a sailboat having steering boards mounted in slots.

U.S. Pat. No. 1,184,207 entitled "Stabilizer For Boats" issued May 23, 1916 illustrates an outrigger type stabilizer that moves up and down exteriorly of the vessel hull.

U.S. Pat. No. 2,150,763 entitled "Barge Construction", issued Mar. 14, 1939 shows a rectangular cargo barge.

U.S. Pat. No. 3,727,572 issued Apr. 17, 1973 describes a fin stabilizer control circuit which accepts signals from a roll angle sensor, a roll rate sensor and a ship's speed sensor. The signals are first processed in a lift order computer which includes an automatic gain control circuit in which the port and starboard lift orders are compared with the square of the ship's speed so as to vary the sensitivity of the control circuits with changes in ship speed and ship residual roll motion. The output signals from the lift order computer are applied to a stroke order computer along with feedback signals representing fin angle and lift. Either feedback signal may be selected for summing with the signal from the lift order computer to produce a stroke order signal that determines the rate of deflection of the stabilizing fins. Limiting circuits in the stroke order computer restrict the stroke order signal in accordance with the larger of the two feedback signals.

U.S. Pat. No. 3,750,607 entitled "Shallow-Draft Boat" issued Aug. 7, 1973 comprises a shallow-draft boat that is operated by omnidirectional thruster means lying below the flat hull, which is stabilized and protected by one or more skegs. The boat has a high beam-to-length ratio, a low depth-to-length ratio, and a low depth-to-beam ratio. Its hull is double-ended and symmetric along both the longitudinal axis and the transverse axis, and the hull has a fully developable surface enabling construction from flat plates without compound curving. One embodiment especially useful as a harbor tugboat, has a high, centrally located deckhouse with an entry well above deck level; this deckhouse is water-tight at the deck, and it may be hinged to swing abut 90° for open access to the hold; the engines lie below this deckhouse and project up into its lower part. Buoyancy compartments are preferably provided at each end, and in some forms of the invention at least one end has adjustable and retractable pusher knees. Other modified forms are simpler and have different special adaptations.

U.S. Pat. No. 3,753,415 entitled "Hydrofoil-Shaped Stabilizing Or Attitude-Affecting Means For Boats", issued Aug. 21, 1973 provides a hydrofoil-shape stabilizer or attitude-changing means for boats, having an elongated frame assembly adapted to be connected to a submerged portion of the hull of a boat with its longitudinal axis parallel to the fore-to-aft axis of the boat. A flexible curtain assembly extends about the frame assembly and is fixed thereto but free to move laterally and to a more limited extent longitudinally relative to the frame assembly. The interior of the curtain assembly communicates with the surrounding water and is deflected to one side or the other relative to the frame assembly by its displacement relative to the water caused by a change in the attitude of the boat so as to form a hydrofoil having a camber for generating forces to oppose the change in attitude to one side or the other when the boat is underway.

U.S. Pat. No. 3,759,208 entitled "Multi-Cargo Barge" contains a stackable lighter having a deck providing a main hatch having a cover and extending the entire length of the lighter along the centerline thereof. The hatch is of a width about one-third that of the lighter and opens to a hold having a length co-extensive with the hatch and width equal to that of the lighter. On the deck at either side of th hatch are disposed a plurality of small hatches properly sized for grain loading equipment and provided with removable covers.

U.S. Pat. No. 3,776,171 entitled "Vessel Having A Control Fin, For Example, A Keel Or Rudder, And Mechanism For Use Therein" issued Dec. 4, 1973 relates to a vessel having a control fin which is fixed to or integral with a shaft rotatable about its longitudinal axis in a bearing attached to the vessel, the shaft being operable to rotate the fin through at least 100° in order to move it between an extended operating position and a retracted position in which the draught of the vessel is substantially reduced with respect to its maximum value, and in order to allow variation of the angle of attack of the fin.

U.S. Pat. No. 3,800,723 entitled "Barge" relates to a barge structure, and to novel hatch-covers that cover the cargo-hold, the hatch-covers being stackable atop each other for compactness when the barge is being loaded or unloaded.

U.S. Pat. No. 3,818,959 entitled "Ship Stabilizer Fin" shows a light-weight, strong, low cost fin for ship stabilization. The fin is composed of plastics materials, such as polystyrene, polyurethane, and the like. The fin is strong and durable in its use as a ship stabilizer. However, the type of materials used in the fin permit the fin to be readily crushed or broken upon impact with other objects, to prevent transmission of forces to the ship which might damage the ship which is stabilized by the fin.

U.S. Pat. No. 3,911,845 entitled "Sailing Hydrofoil Craft" issued Oct. 14, 1975 provides a monohull sailing hydrofoil craft having one or more foils on either side of the craft arranged so that the heel of the craft caused by the wind whilst sailing causes the windward foil or foils to lift clear of the water without any action by the helmsman, the foils being designed so that the righting force they apply by virtue of their shape and without the action of an buoyancy in the foils is such as to counteract the heeling forces.

U.S. Pat. No. 4,217,844 entitled "Barge Dagger Skegs" issued Aug. 19, 1980 shows a row of dagger skegs that project downwardly from the aft portion of the raked counter of a nonpowered, nonsteered barge hull at each side of the longitudinal center line of the hull for stabilizing the barge directionally when towed by a towline trailing a towboat. The upright skegs are of airfoil cross section, and they are tapered downwardly. The leading edge of each skeg, which extends over the major portion of the height of the skeg, is substantially vertical and is spaced rearwardly from the stern counter. The lower end portions of adjacent skegs can be connected by an elongated horizontal bridging member which also is of airfoil cross section having a cambered upper side and a negative angle of incidence.

U.S. Pat. No. 4,326,479 entitled "Movable Skeg For Non-Propelled Barges" issued Apr. 27, 1982 discloses an apparatus for decreasing yaw of a first vessel when the first vessel is pulled by a second vessel which may alternatively be positioned to lessen water resistance when the first vessel is pushed by the second vessel. The apparatus includes a fin movably secured to the first vessel such that the fin may be moved from a first position wherein the fin is in the water to decrease yaw to a second position wherein water resistance is lessened. The apparatus may further provide a linkage for coupling the first and second vessels wherein the apparatus permits freedom of movement of the first vessel relative to the second for pitching, heaving, and if desired rolling motions when the vessels are coupled and further functions a skeg for the first vessel when the first is pulled by second vessel.

U.S. Pat. No. 4,381,725 entitled "Actuators For Small Sailing Craft" issued May 3, 1983 relates to actuators for small sailing craft. Fins extend downwardly from opposite sides of the craft and pivot together when the craft lists. The pivoting tends to right the craft. When righted, the fins function like centerboards to stabilize the craft. Preferably, the fins are linked to a pendulum which responds to the listing of the craft.

SUMMARY OF THE PRESENT INVENTION

The present invention provides an improved bulk-/liquid cargo barge having more maneuverability. It will reduce crabbing, increase fuel efficiency of a vessel propelling a large number of barges as part of a tow, and make navigating safer for such tow arrangements particularly in narrow channels and/or cross wind conditions.

The present invention thus provides an improved liquid/bulk cargo barge having a retractable steering device. The steering device or devices when in the down position will increase maneuverability and also create pivotal points around which the tow can be turned. This is especially important when maneuvering empty barges. A pair of longitudinally extending slots is positioned adjacent the respective port and starboard wing tanks and defining an opening that communicates at least with the barge bottom to provide an opening to the sea under the barge bottom at the respective wing tanks. A pair of respective port and starboard steering members are adapted to move within the respective slots and each being movable between an extended position wherein the steering member extends downwardly well below the barge hull bottom to increase tow maneuverability by creating a steering pivot point and a retracted position wherein the steering member is protectively contained within the slot.

In the preferred embodiment, there are four (4) other steering members, a steering member positioned respectively at each corner of the barge hull at the port and starboard sides of the barge hull and at the respective bow and stern portions thereof. Each steering member is preferably disposed within one of the longitudinally extending slots.

In one embodiment, the steering member is pivotally mounted with respect to the barge hull and positioned to retract to a position within the longitudinally extending slot. In one embodiment, the steering member is respectively slidably disposed within a longitudinally extending slot.

In the preferred embodiment, each steering member is positioned adjacent a sidewall of the barge hull, interiorly thereof so that the steering member does not interfere with a lashing of multiple barges together side by side.

In one embodiment, a pair of longitudinally extending slots are positioned centrally with respect to the barge hull and the slot is surrounded by the cargo hold. A continuous wall extends vertically through the liquid cargo hold area and defines an opening that communicates at least with the barge bottom to provide an opening to the sea under the barge bottom. The vertically extending continuous wall prevents leakage of the liquid cargo to the sea.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
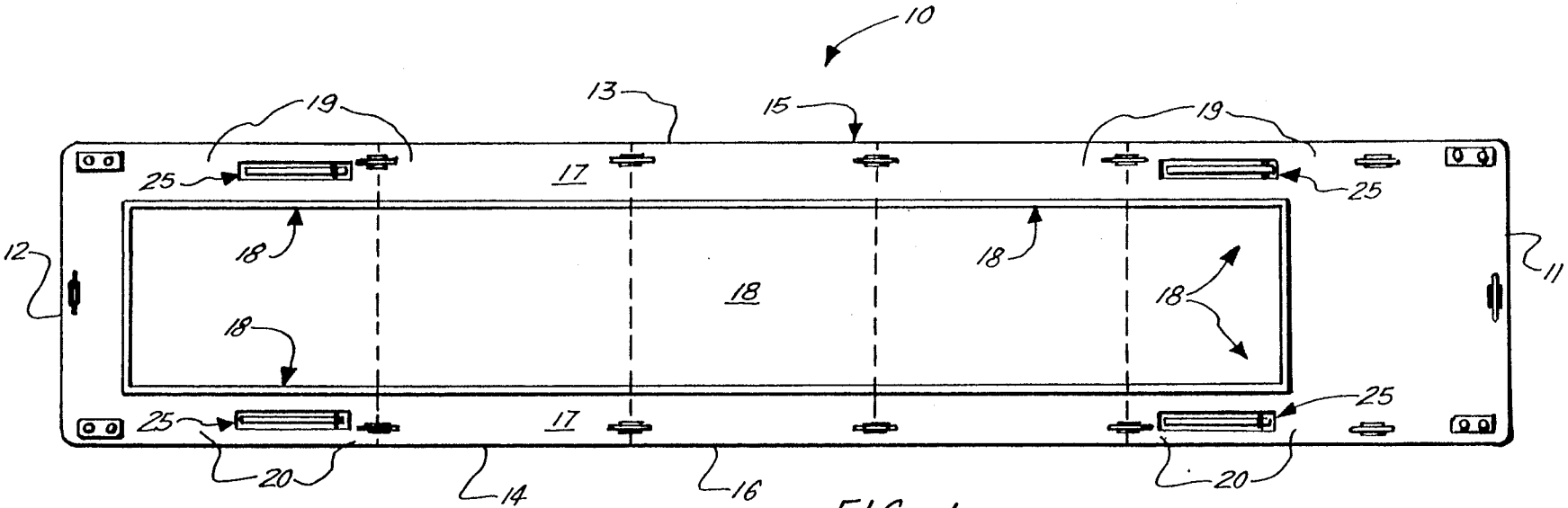
FIG. 1 is a top plan view of the preferred embodiment of the apparatus of the present invention.
Figure 2:
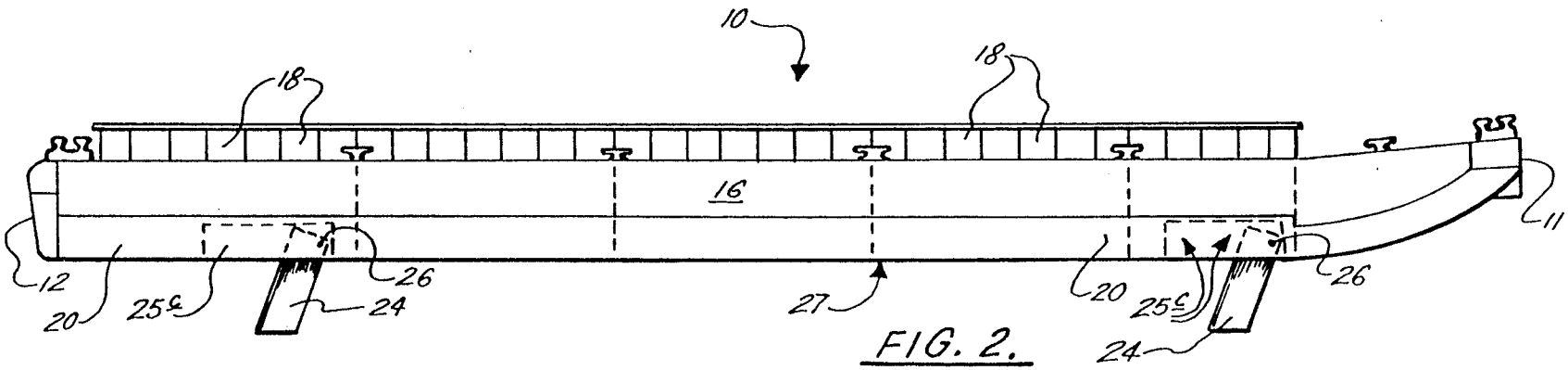
FIG. 2 is a side elevational view of the preferred embodiment of the apparatus of the present invention.

FIGS. 1 and 2 illustrate generally the preferred embodiment of the apparatus of the present invention designated generally by the numeral 10.

In FIGS. 1–2, there can be seen a barge 10 having a bow 11, and stern 12 end portions. The barge includes port side 13 and a starboard side 14. The port side includes a longitudinally extending vertical side wall 15 and on its starboard side a longitudinally extending vertical side wall 16. A deck area 17 is substantially flat, and the entire vessel between its bow 11 and stern 12 end portions and between its port 13 and starboard 14 sides is substantially occupied by a very large cargo area known as hold 18. The hold 18 can carry either bulk or liquid cargo. The peripheral side portions of the barge 10 include a plurality of wing tanks including port side wing tanks 19 and starboard side wing tanks 20.

Figure 10:
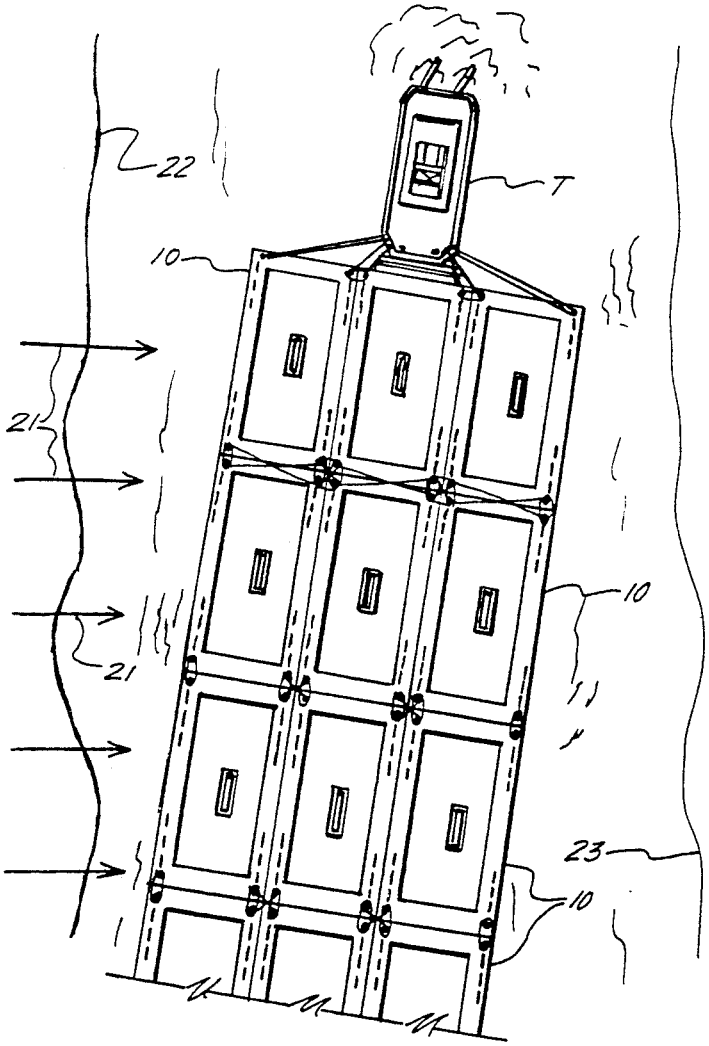
FIG. 10 is a top plan view illustrating a barge tow having a plurality of barges being pushed by a tug as part of a tow.
Figure 11:
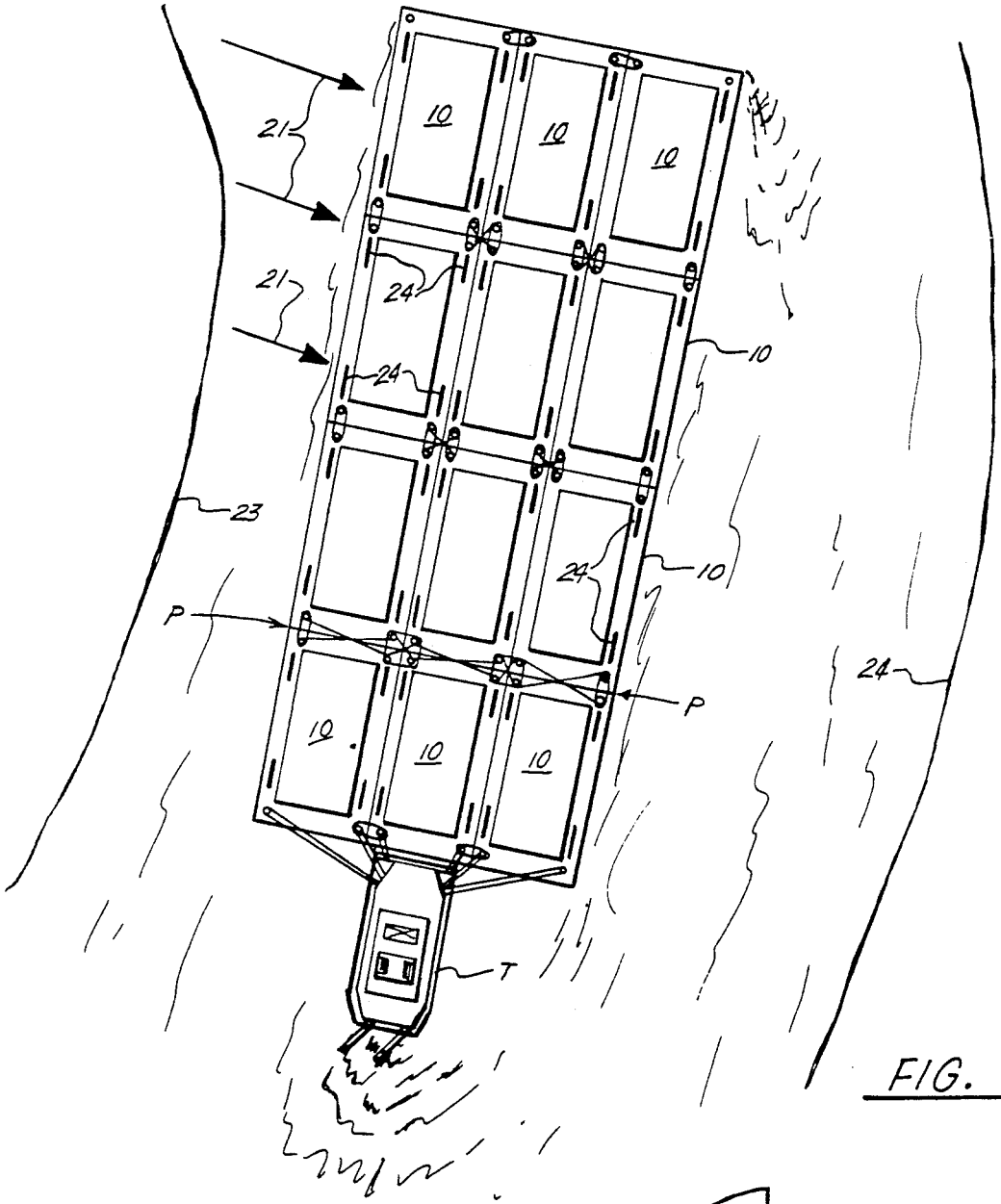
FIGS. 11 and 12 are exemplary tow arrangements illustrating a plurality of barges lashed together.

The wing tanks typically extend from the upper deck 17 downwardly to the vessel bottom 27. The bottom 27 of the barge hull is substantially flat. One skilled in the art understands that the vessel can change elevation with respect to the water dramatically depending upon the amount of cargo which is being contained within the hold 18. Thus, when the hold is empty the barges sit very high in the water and can be difficult to maneuver in high winds, especially cross winds. In FIGS. 10–11 for example arrows 21 schematically illustrate a lateral wind 21 acting upon a barge tow which is being moved by tug T between banks 22, 23 of a river. Selective lowering of some steering members can create a pivot patent for maneuvering.

FIGS. 3–8 illustrate steering members including steering members 24 which is preferably mounted for movement within slot 25. Slot 25 extends downwardly and communicates with the bottom 27 of barge 10 hull. Steering members 24 is designed to move between retracted (hard lines FIG. 4) and exposed (phantom lines FIG. 4). In FIG. 2, the steering members 24 shown in an extended opposite position. Retractability allows the steering members 24 to be withdrawn into the hull such as for example when the barge must be put in shallow water.

Figure 3:
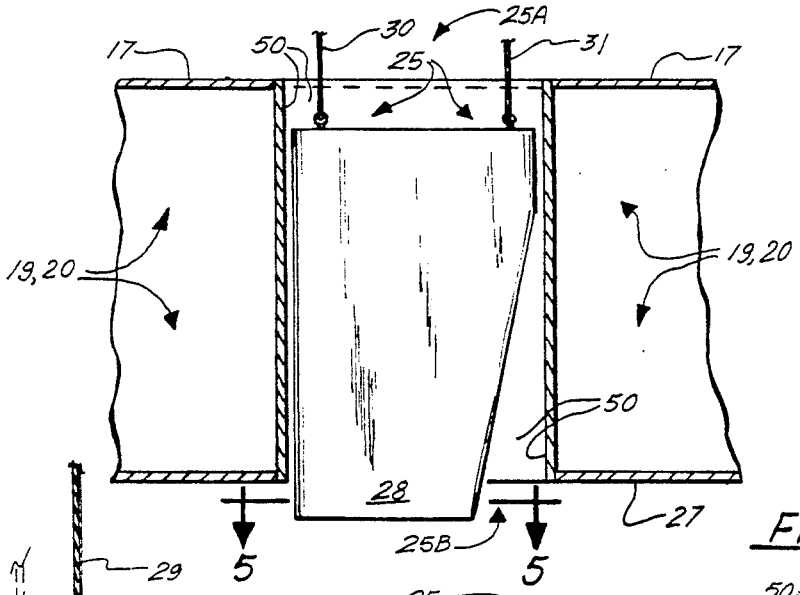
FIG. 3 is a partial fragmentary elevational view of the preferred embodiment of the apparatus of the present invention illustrating a sliding embodiment of the steering mechanism.
Figure 4:
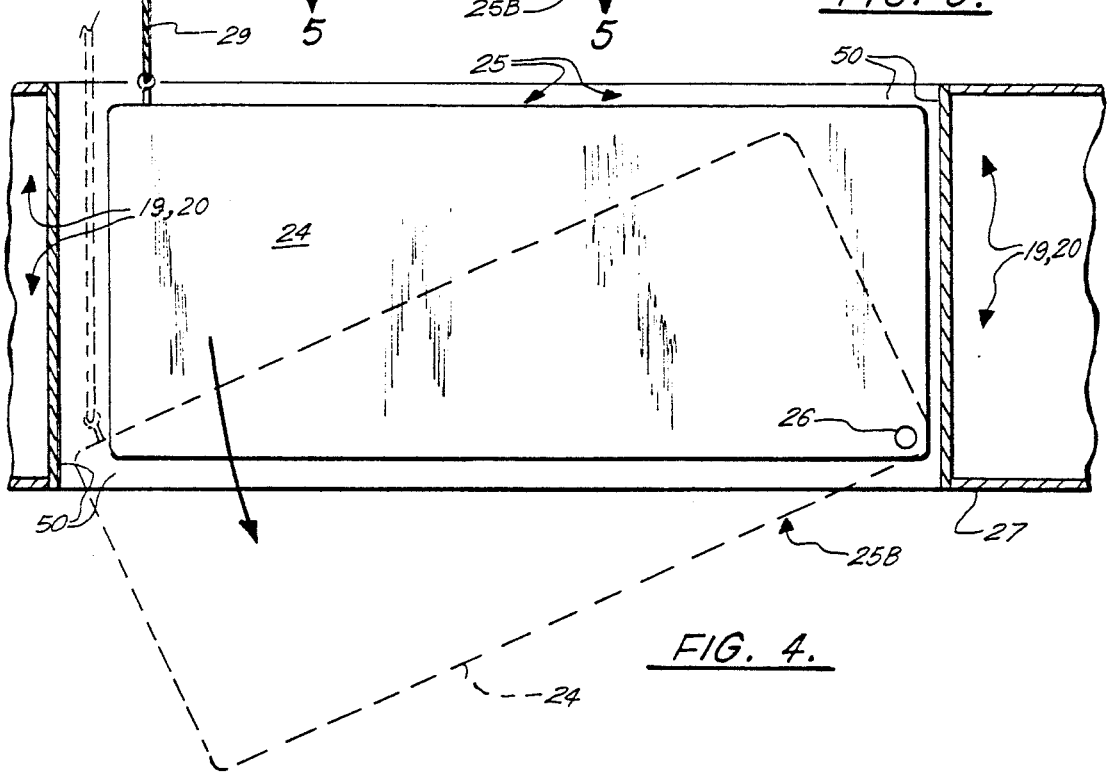
FIG. 4 is a fragmentary side elevational view of an alternate embodiment of the apparatus of the present invention illustrating a pivotal steering member.
Figure 5:
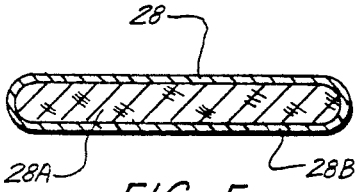
FIG. 5 is a sectional view taken along lines 5—5 of FIG. 3.
Figure 5A:
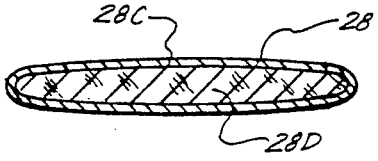
FIG. 5A is a sectional view illustrating an alternate construction of a steering member taken along lines 5—5 of FIG. 3.

In FIG. 3, the steering member is in the form of a slidably disposed steering member 28 mounted in a vertical slot 25 and operated upwardly and downwardly by means of a pair of steel cables for example 30, 31. It should be understood that the cables 30, 31 can be moved upwardly and downwardly by means of a winch, hoist, chain hoist, or other such means. In FIG. 4, a wire rope 29 moves the steering members 24 about pivotal support 26, as shown by the curved arrow in FIG. 4, between an extended and retracted position.

The steering members 24 are mounted interiorly of the barge side walls 15, 16 and exteriorly with respect to the hold 18. Thus, each steering member extends through and communicates with a wing tank 19, 20. In order to isolate each slot 25 from the surrounding wing tank 19, 20, a peripheral wall extends about each steering member 24, thus defining the slot 25. The walls 50 (FIGS. 3 and 4) can extend upwardly and communicate with deck 17 and downwardly to communicate with hull bottom 27. Thus, in the preferred embodiment the slot 25 is open-ended both upwardly and downwardly providing an upper open end 25A and a lower open end 25B. In the embodiment of FIG. 1, the slot can be in the form of a partially extending slot 25C which is open downwardly to communicate with hull bottom 27 but which terminates before reaching deck 17.

Figure 6:
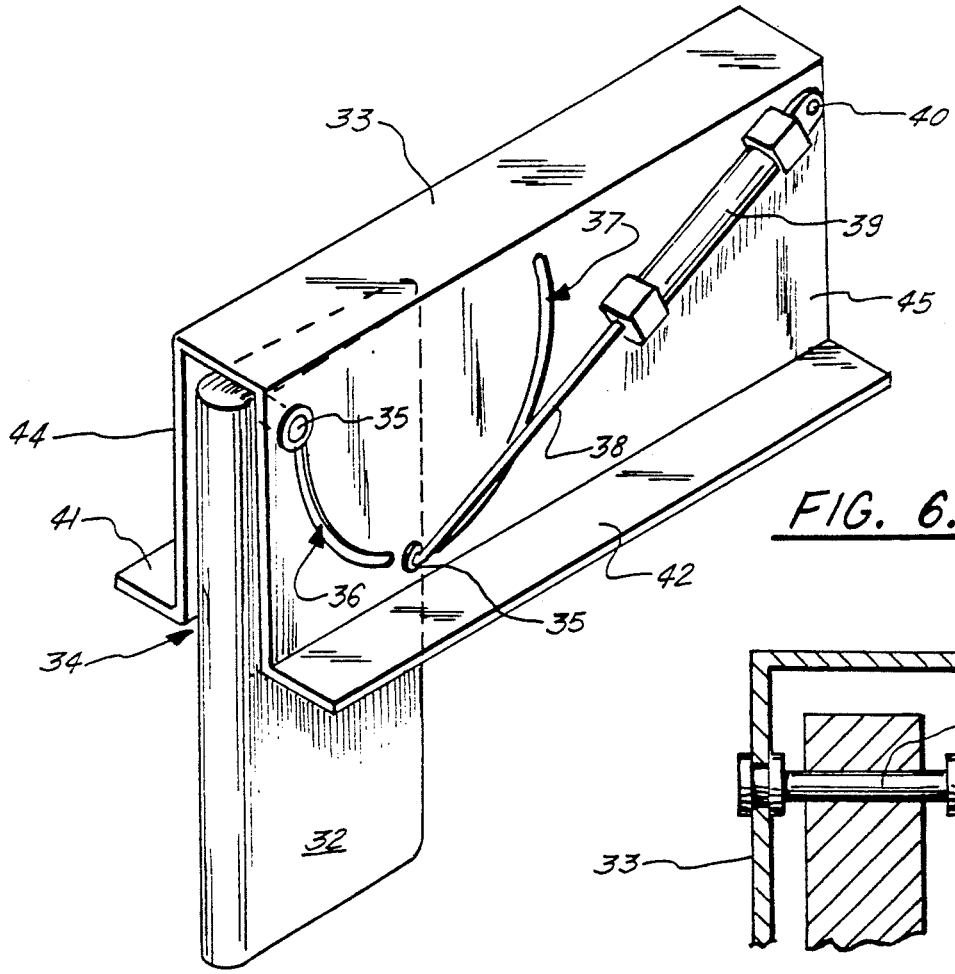
FIG. 6 is a fragmentary perspective view of a third embodiment of the apparatus of present invention.
Figure 7:
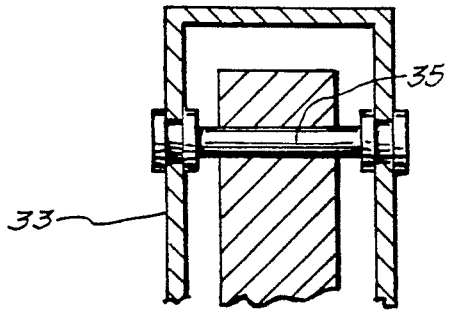
FIG. 7 is a fragmentary view of the embodiment of FIGURE 6.
Figure 8:
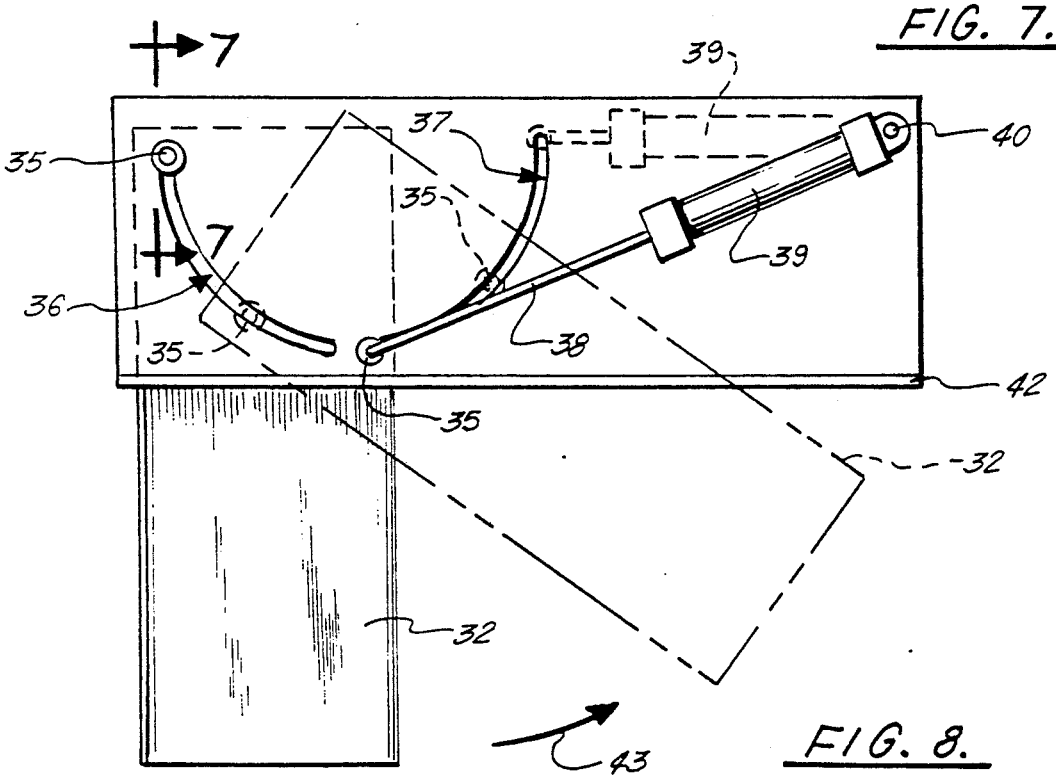
FIG. 8 is a side elevational view of the embodiment of FIG. 6.
Figure 9:
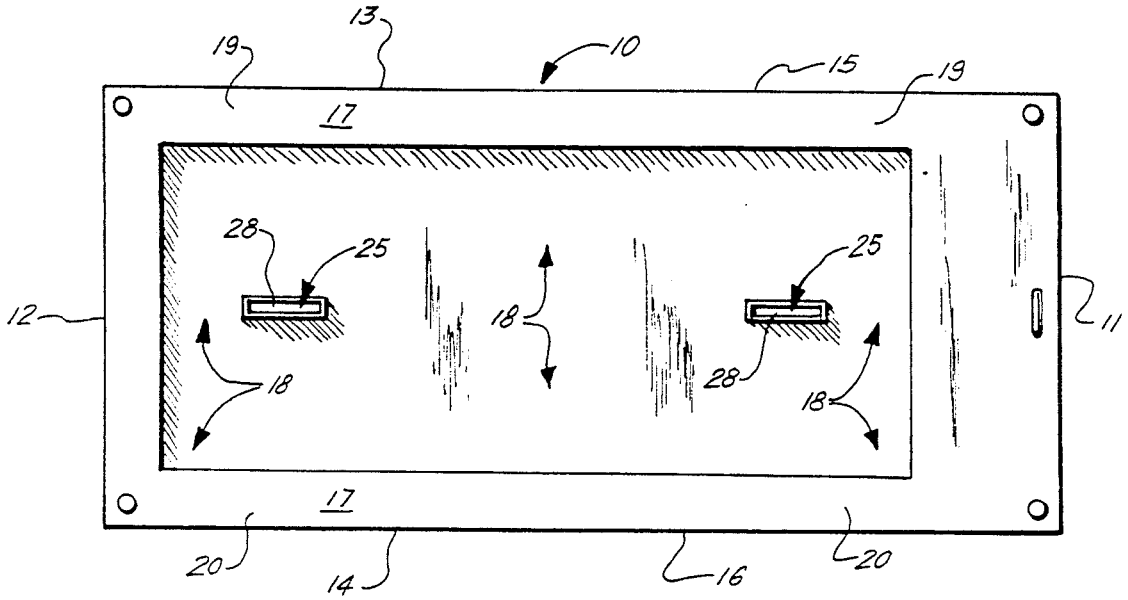
FIG. 9 is a top plan view of a fourth embodiment of the apparatus of the present invention.
Figure 12:
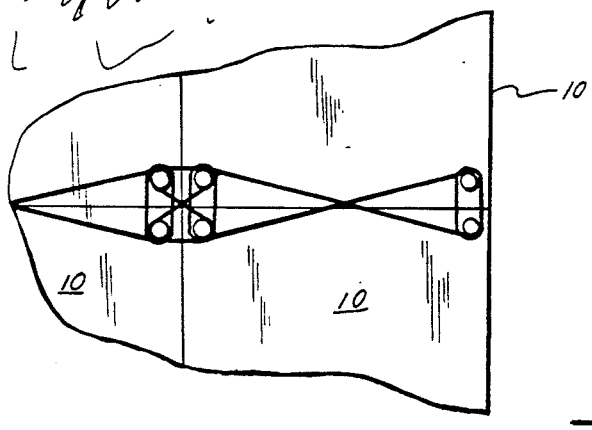

In the embodiment of FIGS. 6–8, the steering member 32 is mounted upon a frame 33 which defines a slot 34. Shaft 35 is connected to steering member 32 and moves within grooved track 36. A similar groove track 37 carries likewise a shaft 35 connected to steering member 32 and pushrod 38 of cylinder 39. Cylinder 39 is attached to frame 33 by means of pinned connection 40 for example. In the preferred embodiment, the frame includes a pair of mounting flanges 41, 42 and a pair of side walls 44, 45. In the preferred embodiment a pair of cylinders 39 and an associated pair of pushrods 38 would be provided and likewise a pair of grooved tracks 36, 37 with respect to each side 44, 45 of frame 33. In FIGS. 11 and 12, an exemplary tow arrangement is shown wherein P designates an example of a pivot, with the adjacent steering members lowered and the other steering member raised. However, a tow of multiple barges can form a different configuration such as one row of barges one behind the other, or two rows of barges, or several barges side-by-side. A tug captain could, for a particular tow configuration, raise some steering members 24 and lower other steering members 24 to optimize maneuverability.

Figure 13:
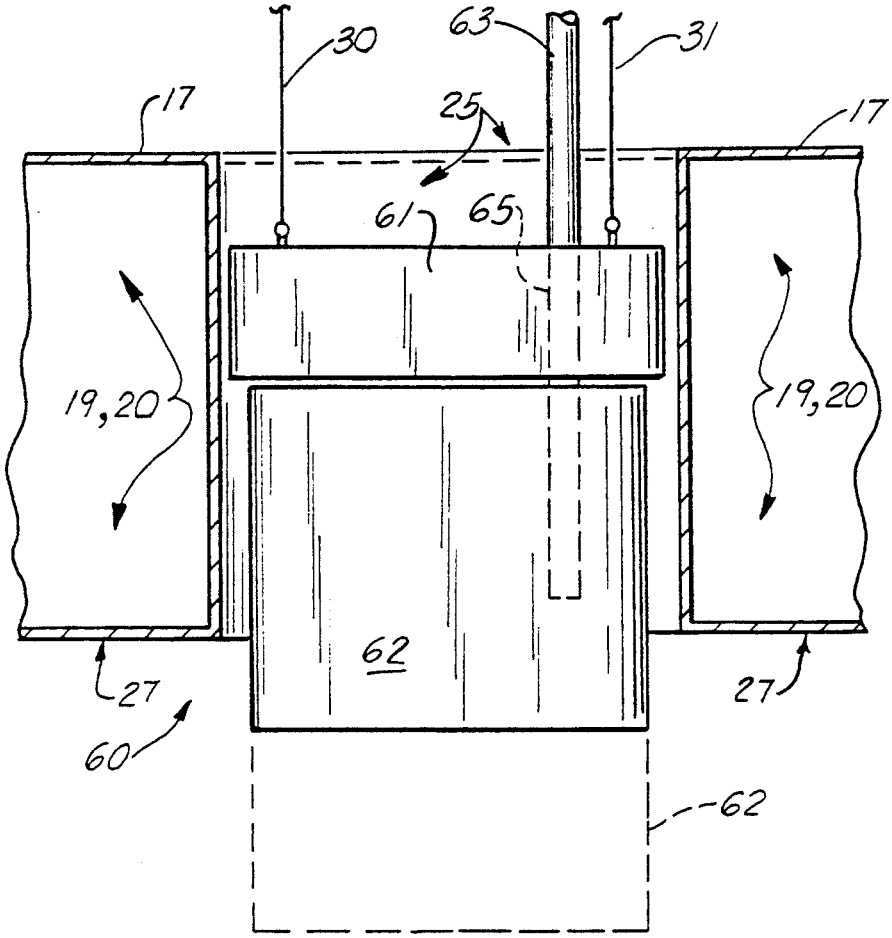
FIG. 13 is a fragmentary elevational view of a fifth embodiment of the apparatus of the present invention.
Figure 14:
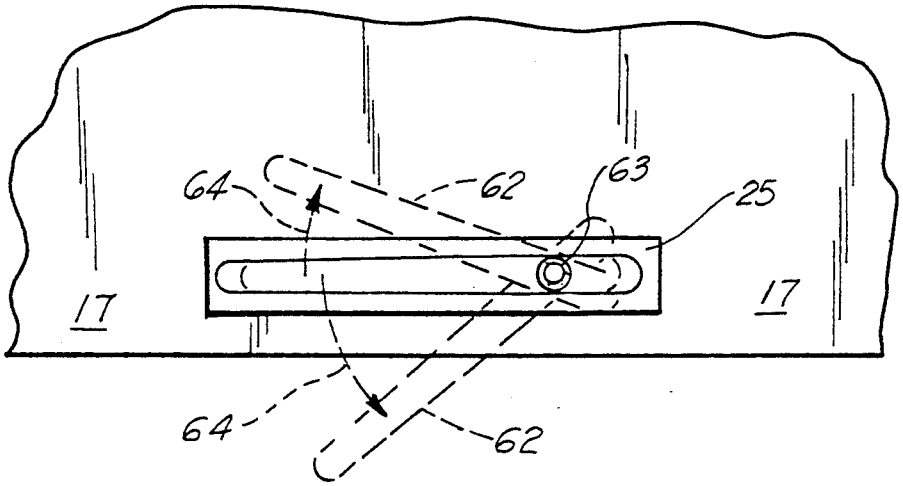
FIG. 14 is a fragmentary plan view of the embodiment of FIG. 15

In FIGS. 13, 14 steering assembly 60 includes upper steering member 61 and lower steering member 62. Steering assembly 60 further comprises vertical shaft 63 which can extend lower steering member 62 below vessel bottom 27, and which allows steering member 62 to rotate about shaft 63 and with respect to upper steering member 61 when lower steering member 62 is positioned below vessel bottom 27 (see arrows 64 in FIG. 14). Shaft 63 could be rigidly attached to steering member 62, and could rotatably move in a vertical opening 65 formed in steering member 61. A commercially available rotary bearing could interface and attach shaft 63 and upper steering member 61. Shaft 63 could be attached to a lifting member such as a winch or the like for raising/lowering shaft 33 and the steering member 60 therewith. Winch operated lines 30, 31 could be used to lift entire steering assembly 60. Lower steering member 62 could also function as a brake when oriented perpendicularly with respect to the direction of travel of vessel 10, i.e., ninety degrees with respect to the position of lower steering member shown in hard lines in FIG. 14.

The apparatus 10 could be manufactured with any suitable structural marine material commonly used in the manufacturing of barges such as steel, structural, marine grade aluminum or the like.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A retractable steering device for maneuvering liquid/bulk cargo carrying barges that can be lashed together to form a tow, comprising:

a) a rectangular barge hull having a generally flat bottom and upper deck, and generally vertical port and starboard sidewalls;

b) a cargo hold contained at the central portion of and extending over a substantial portion of the barge hull area for containing a bulk or liquid cargo;

c) port and starboard wing tanks positioned respectively between the port and starboard sidewalls of the hull and the cargo hold;

d) a pair of longitudinally extending slots positioned adjacent the respective port and starboard wing tanks and defining an opening that communicates at least with the barge bottom to provide an opening to the sea under the barge bottom at the respective wing tanks; and e) a pair of respective port and starboard steering members adapted to move within the respective slots and each being movable between an extended position wherein the steering member extends downwardly well below the barge hull bottom to increase tow maneuverability by creating a steering pivot point when the barge is being pushed, and a retracted position wherein the steering member is protectively contained within the slot, said steering members including a lower steerable portion that can be rotated when the steering member is in the extended position.

2. The steering device of claim 1 wherein there are four of the steering members, a steering member positioned respectively at each corner of the barge hull at the port and starboard sides of the barge hull and at the respective bow and stern portions thereof.

3. The retractable steering device of claim 1 wherein each steering member is movably disposed within one of the longitudinally extending slots.

4. The retractable steering device of claim 1 wherein each steering member is respectively slidably disposed within a longitudinally extending slot.

5. The retractable steering device of claim 1 wherein each steering member is positioned adjacent a sidewall of the barge hull, interiorly of the barge periphery.

6. The retractable steering device of claim 1 further comprising powered means for moving each steering member with respect to its longitudinally extending slot and with respect to the barge hull.

7. A retractable steering system for maneuvering liquid/bulk cargo carrying barges that can be lashed together to form a tow, comprising:

a) multiple rectangular barge hulls lashed together to form a tow, each having a generally flat bottom and upper deck, and generally vertical port and starboard sidewalls;

b) a cargo hold contained at the central portion of and extending over a substantial portion of each barge hull area for containing a bulk or liquid cargo;

c) port and starboard wing tanks positioned respectively between the port and starboard sidewalls of each hull and the cargo hold;

d) a pair of longitudinally extending slots positioned adjacent the respective port and starboard wing tanks and defining an opening that communicates at least with each barge bottom to provide an opening to the sea under each barge bottom at the respective wing tanks;

e) a pair of respective port and starboard steering members adapted to move within the respective slots and each being movable between an extended position wherein the steering member extends downwardly well below each barge hull bottom to increase tow maneuverability by creating a steering pivot point when each barge is being pushed, and a retracted position wherein the steering member is protectively contained within the slot; and f) rotary means for allowing rotation of a lower end portion of the steering members with respect to the upper portions of the steering members.

8. The system of claim 7 wherein steering members of each respective barge can be selectively raised/lowered independently of the other barges lashed together forming a tow, so that one or more steering members can define a pivot extending below the barge lower surfaces to aid in maneuverability of the tow during turning of the tow.

9. The system of claim 8 wherein a plurality of steering members are generally laterally aligned on adjacent, separate barges when lashed together as part of the tow.

* * * * *